US008740574B2

(12) United States Patent
Saukko

(10) Patent No.: US 8,740,574 B2
(45) Date of Patent: Jun. 3, 2014

(54) METHOD AND APPARATUS FOR ADJUSTING A PUMP DRIVE SO THAT A PUMP FLOW CORRESPONDS WITH AN INCOMING FLOW

(75) Inventor: Juha Saukko, Helsinki (FI)

(73) Assignee: ABB Oy, Helsinki (FI)

( * ) Notice: Subject to any disclaimer, the term of this patent is extended or adjusted under 35 U.S.C. 154(b) by 465 days.

(21) Appl. No.: 12/889,138

(22) Filed: Sep. 23, 2010

(65) Prior Publication Data

US 2011/0076163 A1 Mar. 31, 2011

(30) Foreign Application Priority Data

Sep. 30, 2009 (FI) ..... 20095999

(51) Int. Cl.
*F04B 49/06* (2006.01)

(52) U.S. Cl.
USPC ..... 417/20; 417/43; 417/53; 417/44.1; 73/861

(58) Field of Classification Search
USPC ..... 417/20, 33, 36, 43, 53, 44.1; 73/861, 73/861.05, 861.46, 861.49, 861.59, 73/861.06, 198
See application file for complete search history.

(56) References Cited

U.S. PATENT DOCUMENTS

| | | | | |
|---|---|---|---|---|
| 4,544,275 | A | 10/1985 | Hudelmaier | |
| 4,999,117 | A * | 3/1991 | Palmu et al. | 210/744 |
| 5,182,951 | A * | 2/1993 | Jorritsma | 73/861 |
| 5,385,056 | A | 1/1995 | Marsh et al. | |
| 5,497,664 | A * | 3/1996 | Jorritsma | 73/861 |
| 5,831,174 | A * | 11/1998 | Beaudoin | 73/861 |
| 6,481,973 | B1 * | 11/2002 | Struthers | 417/36 |
| 2003/0106370 | A1 * | 6/2003 | Fearnside et al. | 73/149 |
| 2007/0166169 | A1 * | 7/2007 | Venkatachari et al. | 417/36 |
| 2009/0202359 | A1 * | 8/2009 | Duncan | 417/43 |
| 2009/0265863 | A1 * | 10/2009 | Hettinger et al. | 8/158 |

FOREIGN PATENT DOCUMENTS

| | | |
|---|---|---|
| DE | 195 07 698 A1 | 9/1996 |
| EP | 1 770 853 A2 | 4/2007 |
| EP | 2 088 401 A1 | 8/2009 |

(Continued)

OTHER PUBLICATIONS

Wikipedia "Adjustable speed drives" located at http://web.archive.org/web/20080510015706/http://en.wikipedia.org/wiki/Adjustable-speed_drive; archive date May 10, 2008.*

(Continued)

*Primary Examiner* — Devon Kramer
*Assistant Examiner* — Nathan Zollinger
(74) *Attorney, Agent, or Firm* — Buchanan Ingersoll & Rooney PC

(57) ABSTRACT

A method in connection with a pump drive connected to a container or the like, wherein a frequency converter is arranged to supply power to a pump in such a manner that a pump flow ($Q_p$) is responsive to an estimated mean incoming flow ($Q_{est}$) to the container. The method includes draining the container, allowing the container to fill during a predefined filling time ($t_{fill}$) while the pump is inactive, draining the container again at a known pump flow ($Q_{p,nom}$), defining the drainage time ($t_{drain}$), defining an estimated mean incoming flow ($Q_{est}$) on the basis of the filling time ($t_{fill}$), drainage time ($t_{drain}$) and known pump flow ($Q_{p,nom}$), and setting the power supplied by the frequency converter to the pump to be such that the pump flow ($Q_p$) corresponds to the produced estimated mean incoming flow ($Q_{est}$).

21 Claims, 1 Drawing Sheet

(56) References Cited

FOREIGN PATENT DOCUMENTS

| | | |
|---|---|---|
| JP | 58-113596 | 7/1983 |
| JP | 2001-073957 | 3/2001 |
| JP | 2004-306230 | 11/2004 |
| JP | 2008-014230 | 1/2008 |

OTHER PUBLICATIONS

Finnish Search Report of Application No. 20095999 dated May 25, 2010 (with English translation of category of cited documents).
European Search Report dated Feb. 15, 2011, issued in the corresponding European Patent Application No. 10172284.1-1242.

* cited by examiner

METHOD AND APPARATUS FOR ADJUSTING A PUMP DRIVE SO THAT A PUMP FLOW CORRESPONDS WITH AN INCOMING FLOW

RELATED APPLICATION(S)

This application claims priority under 35 U.S.C. §119 to European Patent Application No. 20095999 filed in Europe on Sep. 30, 2009, the entire content of which is hereby incorporated by reference in its entirety.

FIELD

The present disclosure relates to a method and apparatus in connection with a pump drive connected to a container or the like.

BACKGROUND INFORMATION

Pump drives connected to a container or the like are used for many purposes, such as pumping groundwater or service water from a well or pumping other liquid from a container. When the material being pumped is limited, it is possible that the pump cannot be used at constant power all the time. A lengthy use of a pump without a flow through the pump can cause overheating in the pump and the material being pumped, and consequently damage the pump drive.

In known arrangements, pumps can be controlled utilizing surface measuring techniques, such as measuring sensors based on ultra-sound or pressure. Measuring sensors of this type can provide accurate surface data. The flow of the pump can be adjusted to provide the desired surface level. Pump control may also be done by using a cable float level switch or mounted float level switch. With these, pumping between the top and bottom limits of the surface can often be implemented with on/off control without adjustment.

There is always a risk that measuring sensors break, so they reduce the reliability of the operation of the apparatus. For instance, a float level switch can, in time, break due to humidity. Also, contact terminal connection problems may occur. In addition, measuring sensors, their cabling, and the extra work needed to install and service them can cause additional costs.

SUMMARY

A method is disclosed in connection with a pump drive connected to a container, wherein a frequency converter is arranged to supply power to a pump such that a pump flow ($Q_p$) is responsive to an estimated mean incoming flow ($Q_{est}$) to the container. The method includes draining the container, allowing the container to fill during a predefined filling time ($t_{fill}$) while the pump is inactive, draining the container again at a known pump flow ($Q_{p,nom}$), defining a drainage time ($t_{drain}$), defining an estimated mean incoming flow ($Q_{est}$) on a basis of the drainage time ($t_{drain}$) and known pump flow ($Q_{p,nom}$) of the pump; and setting a power supplied by the frequency converter to the pump such that the pump flow ($Q_p$) corresponds to the estimated mean incoming flow ($Q_{est}$).

BRIEF DESCRIPTION OF THE DRAWINGS

The disclosure will now be explained in greater detail in connection with exemplary embodiments and with reference to the attached drawings, in which.

DETAILED DESCRIPTION

According to exemplary embodiments disclosed herein, a size of mean flow into a container or the like can be estimated by utilizing a known flow of a pump controlled by a frequency converter. On the basis of this estimated size, the pump can be set to a desired operating point for pumping, that is, a suitable flow is set for the pump. Information on the size of the estimated mean incoming flow can be updated by repeating the measuring cycle at regular intervals or as necessary.

According to an exemplary embodiment of the disclosure, the emptying of the container or the like can be detected from the decrease in the torque of the pump measured by the frequency converter as the flow of the pump decreases.

According to exemplary methods and apparatus of the disclosure, information on a surface level in the container is not needed and, therefore, there need be no sensors for determining the level. As no separate devices are required for measuring the surface level, the installation of the arrangement of the disclosure can be fast and inexpensive. Exemplary arrangements of the disclosure can also be reliable in operation, because they can contain only parts that are used for pumping. In addition, exemplary arrangements of the disclosure can be less expensive than known arrangements.

According to an exemplary embodiment, a float level switch can be used to generate a top level alarm in the container but not to control the actual pumping process.

Figure 1:
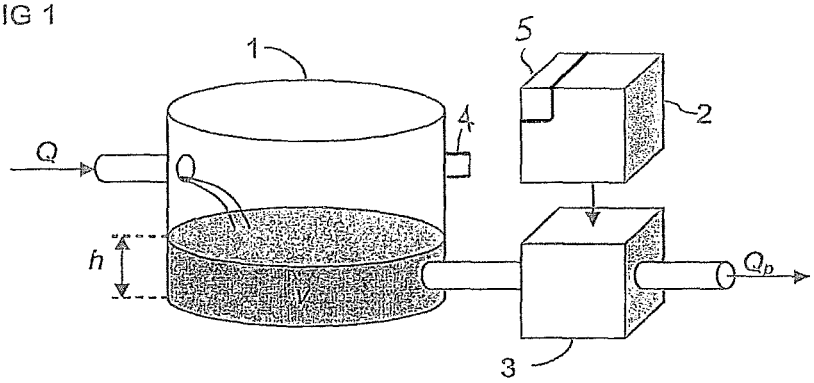
FIG. 1 shows a diagram of an arrangement to which an exemplary method of the disclosure may be applied.

FIG. 1 shows a diagram of an arrangement to which an exemplary method of the disclosure may be applied. Material flows into the container 1 at flow Q and exits from the container 1 through the pump 3 at flow $Q_p$. The surface level h of the material in the container can be maintained in response to the difference between the incoming and exiting flow of the container. A frequency converter 2 can be connected to control an electric motor coupled mechanically to the pump 3 by providing it with power.

Figure 2:
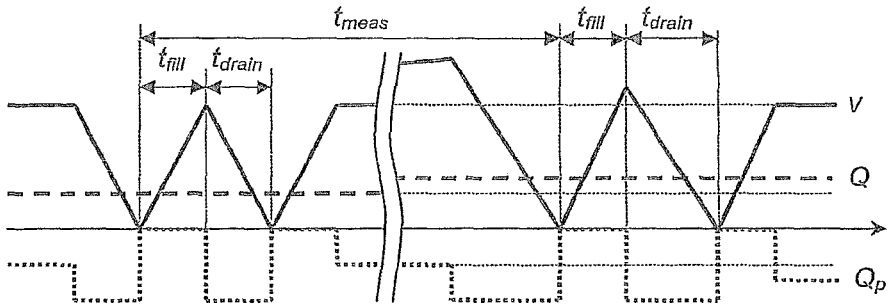
FIG. 2 shows the effect of the incoming flow Q and the flow $Q_p$ exiting through the pump on the quantity v of material in a container.

FIG. 2 shows an effect of the incoming flow Q and the flow $Q_p$ exiting through the pump on the quantity v of material in the container. Prior to using an exemplary method of the disclosure, the container 1 or the like can be drained, if it has not been found empty. When the container 1 or the like is drained, the flow $Q_p$ of the pump 3 decreases. For example, the flow of the pump is responsive to the torque of the pump motor. As a result of the decrease in the pump 3 flow $Q_p$, the torque of the pump 3 motor also decreases. The frequency converter 2 includes means (e.g., a sensor) for measuring the torque and detects the decrease in the torque of the pump 3 motor. According to an exemplary embodiment of the disclosure, the container 1 or the like can be judged to be empty, if the torque is smaller than a predefined percentage of an assumed torque defined for the set flow $Q_p$ of the pump 3. The predefined percentage may be, for example, 20% to 50%.

After detecting that the container 1 is empty, it is allowed to fill up during a predefined filling time $t_{fill}$ while the pump 3 is inactive. After this, the container 1 is drained again at a known pump 3 flow $Q_{p,nom}$, and the time $t_{drain}$ needed for draining can be determined. As above, the draining can now be detected on the basis of the change in the torque used in pumping.

The container 1 is again empty, like at the start of the measuring cycle, so the same quantity of material has flown through the pump 3 during the measuring cycle as has entered the container 1. Thus, the absolute value of the time integral of the incoming flow Q during the measuring cycle equals the time integral of the nominal flow $Q_{p,nom}$ passing through the pump 3 during the measuring cycle. The values of the incoming flow Q and the nominal pump flow $Q_{p,nom}$ have opposite signs, because their flow directions are opposite to each other in relation to the container 1. Therefore, it is possible to calculate an estimate for the incoming flow Q on the basis of the nominal pump 3 flow $Q_{p,nom}$. The nominal pump 3 flow $Q_{p,nom}$ can be calculated by using the specific performance curves of the pump 3. The incoming flow Q may be assumed to be of a constant size during the measuring cycle. Thus, the estimated mean incoming flow $Q_{est}$ corresponding to the incoming flow Q can be:

$$Q_{est} = -\frac{Q_{p,nom} \cdot t_{drain}}{t_{fill} + t_{drain}}.$$

At the end of the measuring cycle, the container 1 can be allowed to fill to a predefined extent so as to have a flow through the pump 3 after the measuring cycle. After the measuring cycle, the power supplied by the frequency converter 2 to the pump 3 can be set to be such that the pump 3 flow $Q_p$ corresponds to the produced estimated mean incoming flow $Q_{est}$. Information on the size of the estimated mean incoming flow $Q_{est}$ can be constantly updated by repeating the measuring cycle at predefined measuring intervals $t_{meas}$ or as desired when, for example, when drainage of the container is detected.

If the drainage time $t_{drain}$ during the measuring cycle is too short, that is, the estimated mean incoming flow $Q_{est}$ is lower than the predefined minimum limit value $Q_{p,min}$, the frequency converter 2 goes into sleep mode in accordance with an exemplary embodiment of the disclosure. The pump 3 is then not in use. The system can return from sleep mode to normal mode due to top limit detection from a measuring sensor 4, such as float level switch, or a new measuring cycle. An example of an exemplary embodiment of the disclosure is a rain water pump station. When it does not rain, the well is empty and the frequency converter can be in sleep mode. When rain begins, water level rises and top limit detection from the measuring sensor 4 returns the frequency converter to normal mode.

Figure 3:
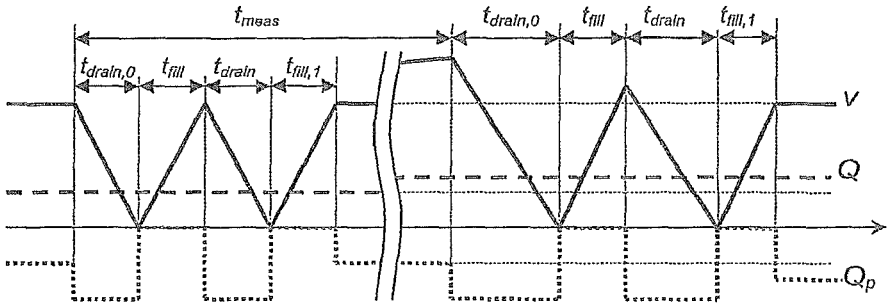
FIG. 3 shows an exemplary embodiment of the disclosure in which the surface level h can be kept at a required level in a container.

According to an exemplary embodiment of the disclosure, the surface level h can be kept at a desired level in the container or the like. The container 1 can then be drained for the first time during the measuring cycle by using the nominal flow of the pump 3. In the exemplary manner shown in FIG. 3, the drainage time $t_{drain,0}$ can be measured and the obtained time can be used together with the nominal flow $Q_{p,nom}$ of the pump 3 and the estimated mean incoming flow $Q_{est}$ to estimate the material volume $v_{est}$ in the container 1 or the like as follows:

$$v_{est} = -(Q_{est} + Q_{p,nom}) \cdot t_{drain,0}$$

The above equation produces the volume of material in the container 1 before the measuring cycle. The estimated mean incoming flow $Q_{est}$ can be calculated earlier with the equation by using the measuring results of the present measuring cycle.

At the end of the measuring cycle, the material volume v in the container 1 can be returned to the desired level by allowing the container to fill while the pump is inactive for the time of a second filling time $t_{fill,1}$. The second filling time is obtained from equation $$t_{fill,1} = \frac{v}{Q_{est}}.$$

If the volume of the container 1 is known, its filling factor may be calculated by dividing the produced estimated material volume $v_{est}$ by the nominal material volume of the container 1. The filling factor data can be utilised in an adjustment where the surface level h is kept at a desired level.

It will be apparent to those skilled in the art that features of the disclosure may be implemented in various ways. The disclosure and its embodiments are thus not restricted to the above examples but may vary within the scope of the claims.

The methods and related apparatus were described above with reference to the respective functions they perform according to an exemplary embodiment. It is to be understood that one or more of these elements and functions can be implemented in a hardware configuration. For example, the respective components can comprise a computer processor 5 configured to execute computer-readable instructions (e.g., computer-readable software), a non-volatile computer-readable recording medium, such as a memory element (e.g., ROM, flash memory, optical memory, etc.) configured to store such computer-readable instructions, and a volatile computer-readable recording medium (e.g., RAM) configured to be utilized by the computer processor as working memory while executing the computer-readable instructions, The methods and related apparatus may also be configured to sense, generate and/or operate in accordance with analog signals, digital signals and/or a combination of digital and analog signals to carry out their intended functions.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method in connection with a pump drive connected to a container, wherein a frequency converter is arranged to supply power to a pump such that a pump flow ($Q_p$) is responsive to an estimated mean incoming flow ($Q_{est}$) to the container, wherein the method comprises:

draining the container;

allowing the container to fill for a predefined filling time ($t_{fill}$) while the pump is inactive;

draining the container again at a known pump flow ($Q_{p,nom}$);

measuring a drainage time ($t_{drain}$);

calculating the estimated mean incoming flow ($Q_{est}$) on a basis of the drainage time ($t_{drain}$) and the filling time ($t_{fill}$) and known pump flow ($Q_{p,nom}$) of the pump; and setting a power supplied by the frequency converter to the pump such that the pump flow ($Q_p$) corresponds to the estimated mean incoming flow ($Q_{est}$).

2. A method as claimed in claim 1, wherein an estimation of an emptiness of the container comprises:

defining a motor torque from the power supplied by the frequency converter to the pump; and judging that the container is empty, if the torque is smaller than a predefined percentage of an assumed torque defined for the pump flow ($Q_p$).

3. A method as claimed in claim 1, comprising:

determining the estimated mean incoming flow ($Q_{est}$) on a basis of the filling time ($t_{fill}$) and drainage time ($t_{drain}$) and known pump flow ($Q_{p,nom}$) as follows:

$$Q_{est} = -\frac{Q_{p,nom} \cdot t_{drain}}{t_{fill} + t_{drain}}.$$

4. A method as claimed in claim 1, comprising:

updating information on a size of the estimated mean incoming flow ($Q_{est}$) by repeating a measuring cycle at predefined measuring intervals ($t_{meas}$) or when drainage of the container is detected.

5. A method as claimed in claim 1, comprising:

activating a sleep mode of the frequency converter, during which the pump is not in use, when the estimated mean incoming flow ($Q_{est}$) is lower than a predefined minimum limit value ($Q_{p,min}$).

6. A method as claimed in claim 5, comprising:

returning the frequency converter from the sleep mode for a new measuring cycle.

7. A method as claimed in claim 5, wherein the container comprises a measuring sensor indicating top limit data of material level, the method comprising:

returning the frequency converter from the sleep mode to normal operation due to a top limit indication from the measuring sensor.

8. A method as claimed in claim 1, comprising:

draining the container for a first time during a measuring cycle using a nominal flow of the pump;

measuring an initial drainage time ($t_{drain,0}$); and using the initial drainage time with the known pump flow ($Q_{p,nom}$) and the estimated mean incoming flow ($Q_{est}$) to estimate a material volume ($v_{est}$) in the container before the measuring cycle as follows:

$$v_{est} = -(Q_{est} + Q_{p,nom}) \cdot t_{drain,0}$$

wherein the estimated mean incoming flow $Q_{est}$ is defined by using measuring results according to a present measuring cycle.

9. A method as claimed in claim 8, comprising:

returning, at the end of the measuring cycle, the material volume (v) in the container to a desired level by allowing the container to fill while the pump is inactive for a time of a second filling time ($t_{fill,1}$), wherein the second filling time ($t_{fill,1}$) is obtained using an equation:

$$t_{fill,1} = \frac{v}{Q_{est}}.$$

10. A method as claimed in claim 8, comprising:

calculating a filling factor of the container by dividing the estimated material volume ($v_{est}$) by a known nominal material volume of the container.

11. A method as claimed in claim 2, comprising:

determining the estimated mean incoming flow ($Q_{est}$) on a basis of the filling time ($t_{fill}$) and drainage time ($t_{drain}$) and known flow ($Q_{p,nom}$) of the pump as follows:

$$Q_{est} = -\frac{Q_{p,nom} \cdot t_{drain}}{t_{fill} + t_{drain}}.$$

12. A method as claimed in claim 2, comprising:

updating information on a size of the estimated mean incoming flow ($Q_{est}$) by repeating a measuring cycle at predefined measuring intervals ($t_{meas}$) or when drainage of the container is detected.

13. A method as claimed in claim 11, comprising:

updating information on a size of the estimated mean incoming flow ($Q_{est}$) by repeating a measuring cycle at predefined measuring intervals ($t_{meas}$) or when drainage of the container is detected.

14. A method as claimed in claim 2, comprising:

activating a sleep mode of the frequency converter, during which the pump is not in use, when the estimated mean incoming flow ($Q_{est}$) is lower than a predefined minimum limit value ($Q_{p,min}$).

15. A method as claimed in claim 13, comprising:

activating a sleep mode of the frequency converter, during which the pump is not in use, when the estimated mean incoming flow ($Q_{est}$) is lower than a predefined minimum limit value ($Q_{p,min}$).

16. A method as claimed in claim 6, wherein the container comprises a measuring sensor indicating top limit data of material level, the method comprising:

returning the frequency converter from the sleep mode to normal operation due to a top limit indication from the measuring sensor.

17. A method as claimed in claim 15, wherein the container comprises a measuring sensor indicating top limit data of material level, the method comprising:

returning the frequency converter from the sleep mode to normal operation due to a top limit indication from the measuring sensor.

18. A method as claimed in claim 2, comprising:

draining the container for a first time during a measuring cycle by using a nominal flow of the pump;

measuring an initial drainage time ($t_{drain,0}$); and using the initial drainage time with the known pump flow ($Q_{p,nom}$) and the estimated mean incoming flow ($Q_{est}$) to estimate a material volume ($v_{est}$) in the container before the measuring cycle as follows:

$$v_{est} = -(Q_{est} + Q_{p,nom}) \cdot t_{drain,0}$$

wherein the estimated mean incoming flow $Q_{est}$ is defined by using measuring results according to a present measuring cycle.

19. A method as claimed in claim 17, comprising:

draining the container for a first time during a measuring cycle by using a nominal flow of the pump;

measuring an initial drainage time ($t_{drain,0}$); and using the initial drainage time with the known pump flow ($Q_{p,nom}$) and the estimated mean incoming flow ($Q_{est}$) to estimate a material volume ($v_{est}$) in the container before the measuring cycle as follows:

$$v_{est} = -(Q_{est} + Q_{p,nom}) \cdot t_{drain,0}$$

wherein the estimated mean incoming flow $Q_{est}$ is defined by using measuring results according to a present measuring cycle.

20. A method as claimed in claim 19, comprising:

returning, at the end of the measuring cycle, the material volume (v) in the container to a desired level by allowing the container to fill while the pump is inactive for a time of a second filling time ($t_{fill,1}$), wherein the second filling time ($t_{fill,1}$) is obtained using an equation:

$$t_{fill,1} = \frac{v}{Q_{est}}.$$

21. A pump drive system, comprising:

a pump;

a container for a liquid to be pumped;

a frequency converter arranged to supply power to the pump such that a pump flow ($Q_p$) is responsive to an estimated incoming flow ($Q_{est}$) to the container; and a processor coupled to a memory arranged as a controller, the controller configured to:

drain the container by using the pump;

allow the container to fill for a predefined filling time ($t_{fill}$) while the pump is inactive;

drain the container again at a known pump flow ($Q_{p,nom}$);

measure a drainage time ($t_{drain}$);

calculate an estimated mean incoming flow ($Q_{est}$) on the basis of the drainage time ($t_{drain}$) and the filling time ($t_{fill}$) and known flow ($Q_{p,nom}$) of the pump; and supply power to the pump via the frequency converter such that the pump flow ($Q_p$) corresponds to the produced estimated mean incoming flow ($Q_{est}$).

* * * * *